US006273689B1

(12) United States Patent
Kenichi et al.

(10) Patent No.: US 6,273,689 B1
(45) Date of Patent: Aug. 14, 2001

(54) ELECTROMAGNETIC PUMP WITH INCREASED ACCURACY

(75) Inventors: Kubota Kenichi, Iwateken; Takehana Norio, Iwate-ken; Sato Kiyoshi, Iwateken; Maita Katuya, Iwate-ken, all of (JP)

(73) Assignee: Mikuniadec Corporation, Iwate-ken (JP)

( * ) Notice: Subject to any disclaimer, the term of this patent is extended or adjusted under 35 U.S.C. 154(b) by 0 days.

(21) Appl. No.: 09/437,969

(22) Filed: Nov. 10, 1999

(30) Foreign Application Priority Data

Nov. 13, 1998 (JP) ..... 10-323253

(51) Int. Cl.[7] ..... F04B 17/04; F04B 39/10
(52) U.S. Cl. ..... 417/417; 417/555.1; 417/549
(58) Field of Search ..... 417/417, 555.1, 417/549

(56) References Cited

U.S. PATENT DOCUMENTS 3,302,582 * 2/1967 Kofink ..... 103/53
4,306,842 * 12/1981 Masaka ..... 417/417
4,632,645 * 12/1986 Kawakami et al. ..... 417/417
4,643,653 * 2/1987 Masala et al. ..... 417/417
4,895,495 * 1/1990 Arai ..... 417/360
5,073,095 * 12/1991 Thomas, Sr. ..... 417/417

* cited by examiner

*Primary Examiner*—Timothy S. Thorpe
*Assistant Examiner*—Timothy P. Solak
(74) *Attorney, Agent, or Firm*—Goodman & Teitelbaum, Esqs.

(57) ABSTRACT

An enabling an easy increase in the accuracy of a plunger stroke is provided in an electromagnetic pump, in which an inner yoke and a plunger constitute a magnetic circuit, and where an electromagnetic force acts on the magnetic circuit so that a magnetic gap between the inner yoke and the plunger is diminished. The plunger is reciprocated within a cylinder by the electromagnetic force and a restoration force of a spring. In such an electromagnetic pump, the stroke of the plunger is limited by two planes of respective members disposed opposite each other with the cylinder being disposed therebetween.

8 Claims, 3 Drawing Sheets

ELECTROMAGNETIC PUMP WITH INCREASED ACCURACY

BACKGROUND OF THE INVENTION

1. Field of the Invention

The present invention relates to an electromagnetic pump, and more particularly, to an electromagnetic pump suitable for use in a separating oil pump of a two-cycle engine.

2. Background Art

An electromagnetic pump—which applies a pulse current to a solenoid, to thereby reciprocate a plunger and draw oil in and force oil out—has conventionally been employed as a separate oil pump of a two-cycle engine. FIG. 3 shows an example of such a conventional electromagnetic pump. An illustrated plunger 2 is slidably fitted into a cylinder 1 formed from non-magnetic material, such as aluminum or brass, and is forced rightward by means of restoration force of a compression coil spring 8.

An inner yoke 3 opposite the plunger 2 is pressingly fitted into an end yoke 4, and the end yoke 4 is fixed to an outer yoke 5 by means of caulking. A nipple 6 presssingly-fitted into the outer yoke 5 is in close proximity to the plunger 2. The plunger 2, the inner yoke 3, the end yoke 4, the outer yoke 5, and the nipple 6 are formed from magnetic material and constitute a magnetic circuit.

A coil 16, which is wound around a plastic coil bobbin 13 and applies magnetomotive force to the magnetic circuit, is covered with the coil bobbin 13 and a plastic mold 14. The plastic mold 14 is housed in the space which surrounds the cylinder 1 and which is defined by the end yoke 4 and the outer yoke 5. The edge of the outer yoke 5 is locked to the end yoke 4 by means of caulking, while the plastic mold 14 remains in pressing contact with the end yoke 4 by means of a cushion member 23 interposed between the outer yoke 5 and the plastic mold 14. Power is supplied to the coil 16 from an electrode 15 embedded in the plastic mold 14.

A valve seat 7 is pressed into the inner yoke 3 while being properly positioned. A discharge valve 12 is forced by the compression coil spring 10 so as to close a flow channel of the valve seat 7. A valve seat 24 is pressingly fitted into the plunger 2. An inlet valve 11 is forced by a compression coil spring 9 so as to close a flow channel of the valve seat 24.

An O-ring 19 hermetically seals a space between the inner yoke 3 and the cylinder 1, and an O-ring 17 hermetically seals a space between the nipple 6 and the cylinder 1. A spacer 20 interposed between the nipple 6 and the plunger 2 controls the maximum magnetic gap between the plunger 2 and the inner yoke 3; i.e., a plunger stroke.

In the electromagnetic pump having the foregoing configuration, when an electric current flows through the coil 16, a magnetic field develops in the magnetic gap between the plunger 2 and the inner yoke 3, as a result of which the plunger 2 is attracted by the inner yoke 3 against the restoration force of the compression coil spring 8. When the electric current flowing through the coil 16 is shut off, the plunger 2 is separated from the inner yoke 3 and is brought into pressing contact with the spacer 20, by means of restoration force of the compression coil spring 8.

The plunger 2 reciprocates in the manner as mentioned previously. When the plunger 2 is moved rightward the discharge valve 12 is closed and the inlet valve 11 is opened, whereby oil is drawn into a pump chamber (a space between the discharge valve 12 and the inlet valve 11) from the nipple 6 10 and the center hole of the plunger 2, by way of a gap between the inlet valve 11 and the valve seat 24. In contrast, when the plunger 2 is moved leftward, the discharge valve 12 is opened and the inlet valve 11 is closed, whereby oil is forced out to an oil flow channel of the inner yoke 4 from the pump chamber, by way of the space between the discharge valve 12 and the valve seat 7. An engine control unit controls a pulse current which is to be applied to the coil 16 in response to a signal output from a sensor for detecting the working state of the engine, thus controlling the amount of engine oil to be supplied.

The flow rate of the electromagnetic pump is determined from the number of pulses of the electric current and plunger strokes. The stroke of the plunger 2 corresponds to a difference between the distance between the end face of the spacer 20 and the end face of the inner yoke 3 and the distance between the end face of the plunger 2 and a plane at an opposite end portion of the plunger 2, which contacts the end face of the spacer 20. Tolerances of many parts contribute to the distance between the end face of the spacer 20 and the end face of the inner yoke 3.

More specifically, tolerances stemming from the pressing of the nipple 6 into the outer yoke 5, fixing of the end yoke 4 to the outer yoke 5 by caulking, and dimensional tolerances of the nipple 6, the cylinder 1, the plunger 2, the spacer 20, and the inner yoke 5, contribute to the distance.

In terms of electrical conditions under which the plunger 2 can be actuated, the diameter of the plunger is limited to a value of 6 mm to 7 mm. If the diameter of the plunger is made smaller than this range, the plunger cannot be actuated. Further, in order to diminish power consumption, the stroke of the plunger 2 must be made smaller. In consideration of the amount of oil required to be delivered, the stroke of the plunger 2 assumes a value of 0.5 mm or less for a two-cycle engine. If the tolerance of flow rate is reduced to 10% or less, variations in the stroke of the plunger 2 must be held to ±0.05 mm or less. Thus, in order to reduce the tolerance of stroke of the plunger, the spacer 20 must be prepared in various sizes, and adjustment of stroke requires a lot of time.

Further, since the compression coil spring 9 for constraining the inlet valve 11 is disposed within the pump chamber, the dead volume of the pump chamber becomes large, thereby resulting in a decrease in compression ratio and a drop in air displacement capability. If the air displacement capability of the pump is too small, in the worst case the pump fails to supply oil because of an air-lock phenomenon.

The present invention has been conceived in view of the foregoing problems of the prior art, and an object of the present invention is to provide an electromagnetic pump capable of readily and precisely determining the stroke of a plunger. Another object of the present invention is to provide an electromagnetic pump having large air displacement capability.

SUMMARY OF THE INVENTION

To these ends, the present invention provides an electromagnetic pump, in which a plunger is reciprocated within a cylinder by means of the restoration force of a spring and electromagnetic force acting on a magnetic circuit, comprising an inner yoke and the plunger, so as to reduce a magnetic gap between the inner yoke and the plunger, wherein the stroke of the plunger is limited by two planes of two members disposed so as to be opposite each other with the cylinder interposed therebetween.

Preferably, one of the two members corresponds to a ring-shaped spacer, and the spacer is brought into pressing contact with the cylinder by means of a wave washer.

Preferably, a fluid inlet channel is formed within the plunger; a spring receiving section which extends to the inside of the inlet channel of the plunger is formed in the inlet valve which opens or closes the inlet channel; and a spring for constraining the inlet valve is locked to the spring receiving section.

Preferably, a protuberance is formed on a plastic mold covering a coil for applying a magnetomotive force to the plunger, and the protuberance is deformed to fix the plastic mold by means of fixing an end yoke to an outer yoke by caulking while the plastic mold is housed within the space defined by the end yoke and an outer yoke, which constitute the magnetic circuit.

DETAILED DESCRIPTION OF THE PREFERRED EMBODIMENTS

Figure 1:
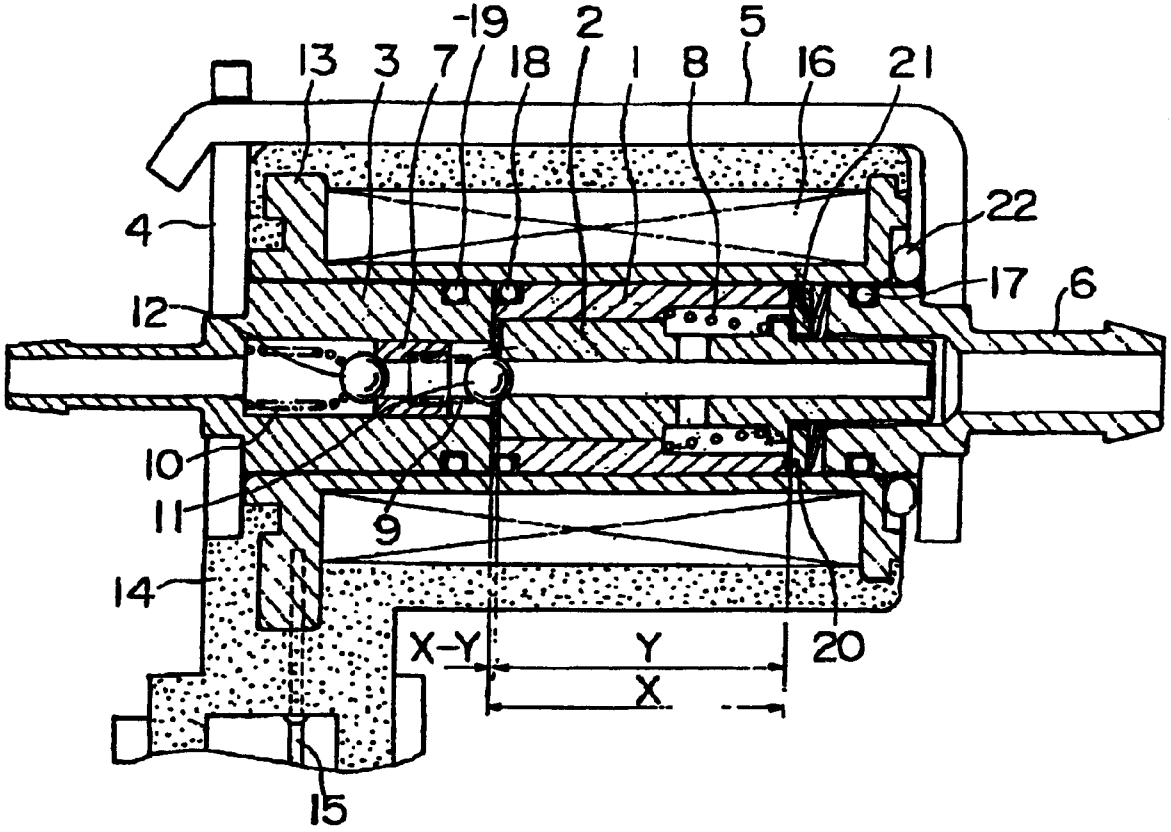
FIG. 1 is a cross-sectional view showing an electromagnetic pump according to a first embodiment of the present invention.

Preferred embodiments of the present invention will be described hereinbelow by reference to the accompanying drawings. FIG. 1 is a cross-sectional view showing an electromagnetic pump to be used as a separate oil pump of an engine according to a first embodiment of the present invention. An illustrated plunger 2 is slidably fitted into a cylinder 1 formed from non-magnetic material, such as aluminum or brass, and is forced rightward by means of a compression coil spring 8.

An inner yoke 3 opposite the plunger 2 is pressingly fitted into an end yoke 4, and the end yoke 4 is fixed to an outer yoke 5 by means of caulking. A nipple 6 presssingly-fitted into the outer yoke 5 is in close proximity to the plunger 2. The plunger 2, the inner yoke 3, the end yoke 4, the outer yoke 5, and the nipple 6 are formed from magnetic material and constitute a magnetic circuit.

A coil 16, which is wound around a plastic coil bobbin 13 and applies magnetomotive force to the magnetic circuit, is covered with the coil bobbin 13 and a plastic mold 14. While the plastic mold 14 is housed in the space which surrounds the cylinder 1 and is defined by the end yoke 4 and the outer yoke 5, the edge of the outer yoke 5 is locked to the end yoke 4 by means of caulking. Power is supplied to the coil 16 from an electrode 15 embedded in the plastic mold 14.

A valve seat 7 is pressed into the inner yoke 3 while being properly positioned. A discharge valve 12 is forced so as to close a flow channel of the valve seat 7 by means of the compression coil spring 10. An inlet valve 11 is forced so as to close a flow channel of the valve seat which is formed within the plunger 2 by means of a compression coil spring 9.

An O-ring 19 hermetically seals a space between the inner yoke 3 and the coil bobbin 13, and an O-ring 17 hermetically seals a space between the nipple 6 and the coil bobbin 13. Further, an O-ring 18 hermetically seals a space between the cylinder 1 and the coil bobbin 13, and an O-ring 22 hermetically seals a space between the outer yoke 5 and the coil bobbin 13. A spacer 20 whose opposite sides are flat is formed into a ring shape and is forced by means of a wave washer 21 interposed between the nipple 6 and the spacer 20, to thereby bring the left end face of the cylinder 1 into pressing contact with the inner yoke 3, as well as to lock the plunger 2 so as to limit the stroke of the plunger 2.

As shown in the drawing, when the length of the cylinder 1 is taken as X, and the illustrated distance between the end face of the plunger 2 and a plane at an opposite end portion of the plunger 2, which contacts the end face of the spacer 20, is taken as Y, the stroke of the plunger 2 is expressed by X-Y. The accuracy of the stroke of the plunger 2 is affected by only the dimensional accuracy of the cylinder 1 and the dimensional accuracy of the plunger 2. The dimensional accuracy of length of the cylinder 1 and the dimensional accuracy of length of the plunger 2 can be readily improved by means of turning. Accordingly, the accuracy of the stroke of the plunger 2 can be readily improved. The method of actuating the electromagnetic pump of the present embodiment is the same as that which has already been described in connection with the conventional example.

Figure 2:
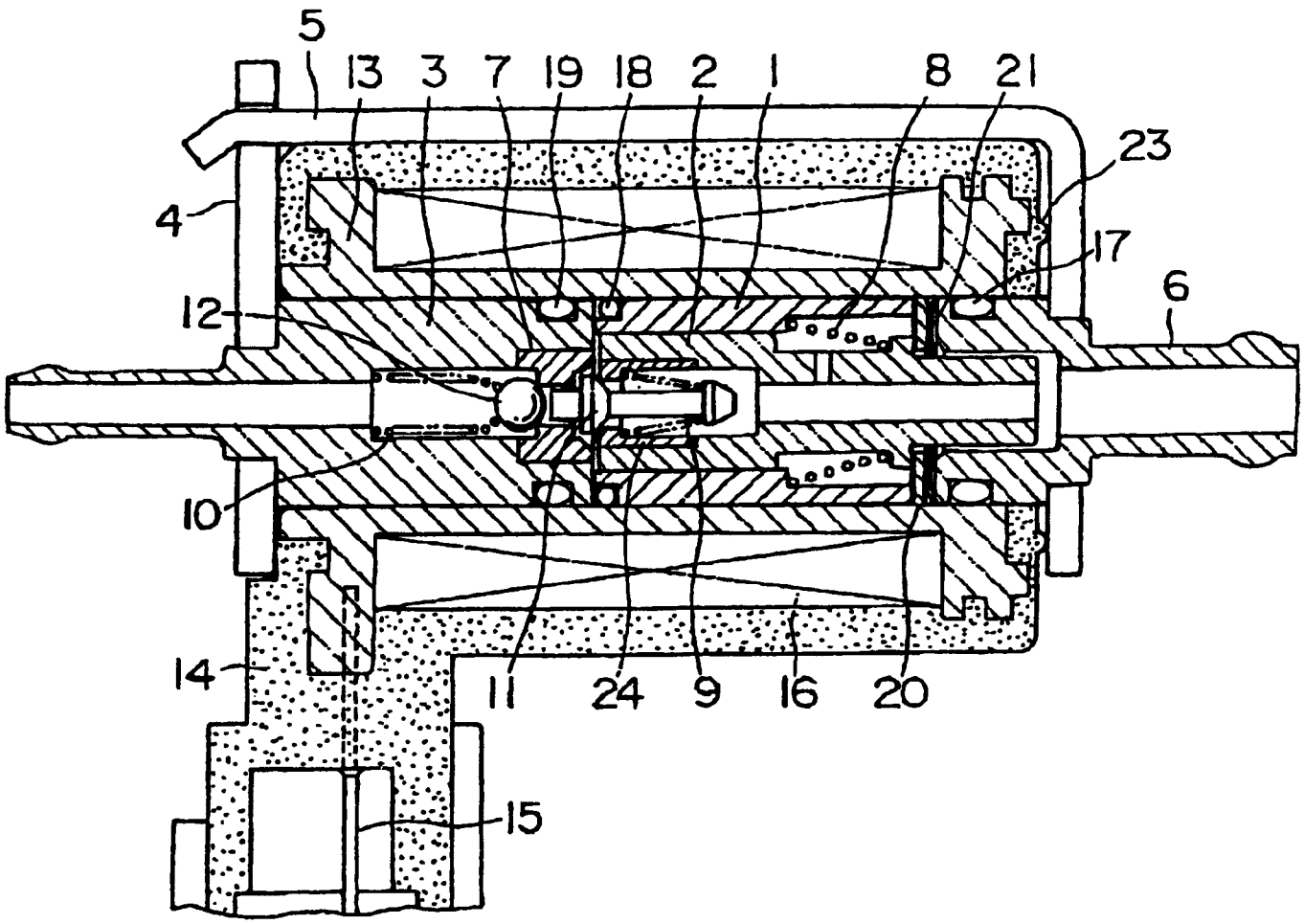
FIG. 2 is a cross-sectional view showing an electromagnetic pump according to a second embodiment of the present invention.
Figure 3:
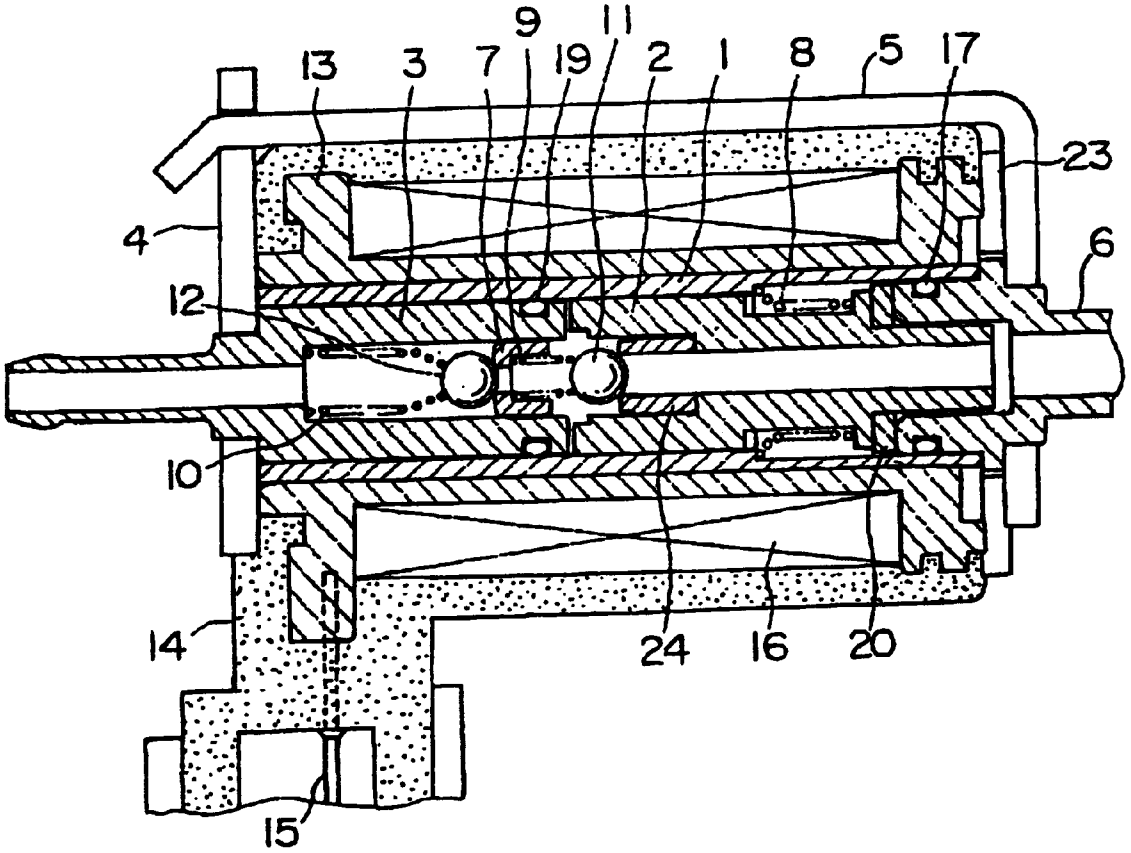
FIG 3 PRIOR ART
FIG. 3 is a cross-sectional view showing a prior art example of a conventional electromagnetic pump.

FIG. 2 is a cross-sectional view showing an electromagnetic pump used as a separating oil pump of an engine according to a second embodiment of the present invention. In place of the O-ring 22 used in the first embodiment, a protuberance 23 is provided on the face of the plastic mold 14 facing the outer yoke 5. The height of the protuberance 23 is set such that a portion of the protuberance 23 is deformed when the edge of the outer yoke 5 is locked to the end yoke 4 by caulking while the plastic mold 14 is housed in the space between the end yoke 4 and the outer yoke 5. Although in the second embodiment the protuberance 23 is formed on the face of the plastic mold 14 facing the outer yoke 5, the protuberance 23 may be provided on the face of the plastic mold 14 facing the end yoke 4, or the protuberances may be provided on both the face of the plastic mold 14 facing the outer yoke 5 and the end yoke 4. Further, the protuberance 23 may be provided in one spot or in the form of a continuous raised ring.

A spring receiving section, which extends into the inside of an inlet channel of the plunger 2, is formed in the inlet valve 11. The compression coil spring 9 for constraining the inlet valve 11 is locked in the spring receiving section. In other respects, the electromagnetic pump according to the present embodiment is identical in structure with the electromagnetic pump according to the first embodiment. The second embodiment yields the same advantageous results as those yielded in the first embodiment. Moreover, in the electromagnetic pump of the second embodiment, the dead volume of the pump chamber becomes smaller, thus increasing the air displacement capability of the electromagnetic pump.

Although the embodiments have described a case where the present invention is applied to a separating oil pump of the engine, the present invention can also be applied to another electromagnetic pump such as a fuel supply pump for use with a burner.

In the electromagnetic pump of the present invention, the accuracy of stroke of the plunger cannot be affected by the caulked state of the outer yoke or the dimensional accuracy of parts. The accuracy of stroke of the plunger is affected by solely the dimensional accuracy of the plunger and the cylinder. The dimensional accuracies of the cylinder and the plunger in the longitudinal direction can be readily improved by means of turning, and hence the accuracy of stroke of the plunger can be easily improved.

In the electromagnetic pump of the present invention, the dead volume of the pump chamber is reduced, and the air displacement capability of the pump can be improved.

In the electromagnetic pump, the protuberance is formed on the end face of the plastic mold. When the edge of the outer yoke 5 is locked to the end yoke 4 by caulking while the plastic mold 14 is housed in the space between the end yoke 4 and the outer yoke 5, the protuberance is deformed, thus locking the plastic mold 14. Accordingly, the necessity for the O-ring 22 can be reduced, and the number of components of the assembly can be diminished.

What is claimed is:

1. An electromagnetic pump comprising:

a cylinder;

a plunger being reciprocated in a first direction and then in an opposite second direction within said cylinder;

a magnetic circuit including an inner yoke and said plunger, said inner yoke and said plunger being spaced apart by a magnetic gap;

magnetomotive force means acting on said magnetic circuit to stroke said plunger in said first direction to reduce said magnetic gap between said inner yoke and said plunger;

a spring providing a restoration force to return said plunger in said opposite second direction; and stroke limiting means to limit the stroke of said plunger in said first direction;

said stroke limiting means including two members having respective planes thereof disposed opposite each other with the cylinder being interposed between said respective planes.

2. The electromagnetic pump as claimed in claim 1, wherein one of the two members is to a ring-shaped spacer, and the spacer is forced into pressing contact with the cylinder by a wave washer.

3. The electromagnetic pump as claimed in claim 2, wherein a fluid inlet channel is provided within the plunger; a spring receiving section which extends to an inside of the inlet channel of the plunger is provided an inlet valve which opens or closes the inlet channel; and a spring for constraining the inlet valve is locked to the spring receiving section.

4. The electromagnetic pump as claimed in claim 3, wherein a protuberance is provided on a plastic mold covering a coil for applying a magnetomotive force to the plunger, and the protuberance is deformed to fix the plastic mold by fixing an end yoke to an outer yoke by caulking while the plastic mold is housed within a space defined by the end yoke and the outer yoke, which constitute the magnetic circuit.

5. The electromagnetic pump as claimed in claim 2, wherein a protuberance is provided on a plastic mold covering a coil for applying a magnetomotive force to the plunger, and the protuberance is deformed to fix the plastic mold by fixing an end yoke to an outer yoke to an outer yoke by caulking while the plastic mold is housed within a space defined by the end yoke and the outer yoke, which constitute the magnetic circuit.

6. The electromagnetic pump as claimed in claim 1, wherein a fluid inlet channel is provided within the plunger; a spring receiving section which extends to an inside of the inlet channel of the plunger is provided in an inlet valve which opens or closes the inlet channel; and a spring for constraining the inlet valve is locked to the spring receiving section.

7. The electromagnetic pump as claimed in claim 6, wherein a protuberance is provided on a plastic mold covering a coil for applying a magnetomotive force to the plunger, and the protuberance is deformed to fix the plastic mold by fixing an end yoke to an outer yoke by caulking while the plastic mold is housed within a space defined by the end yoke and the outer yoke, which constitute the magnetic circuit.

8. The electromagnetic pump as claimed in claim 1, wherein a protuberance is provided on a plastic mold covering a coil for applying a magnetomotive force to the plunger, and the protuberance is deformed to fix the plastic mold by fixing an end yoke to an outer yoke by caulking while the plastic mold is housed within a space defined by the end yoke and the outer yoke, which constitute the magnetic circuit.

* * * * *